United States Patent [19]

Furusawa et al.

[11] Patent Number: 4,925,781

[45] Date of Patent: May 15, 1990

[54] SILVER HALIDE COLOR PHOTOGRAPHIC MATERIAL

[75] Inventors: Genichi Furusawa; Takatoshi Ishikawa; Nobuo Furutachi; Takeshi Hirose, all of Kanagawa, Japan

[73] Assignee: Fuji Photo Film Co., Ltd., Kanagawa, Japan

[21] Appl. No.: 918,225

[22] Filed: Oct. 14, 1986

[30] Foreign Application Priority Data

Oct. 14, 1985 [JP] Japan ..... 60-228268

[51] Int. Cl.[5] ..... G03C 1/46; G03C 7/38

[52] U.S. Cl. ..... 430/505; 430/386; 430/387; 430/548; 430/558

[58] Field of Search ..... 430/548, 505, 558, 373, 430/936, 943, 381, 383, 386, 387

[56] References Cited

U.S. PATENT DOCUMENTS

| | | | |
|---|---|---|---|
| 4,192,681 | 3/1980 | Fujiwhara et al. | 430/373 |
| 4,366,233 | 12/1982 | Nakamura | 430/393 |
| 4,469,780 | 9/1984 | Hirai et al. | 430/373 |
| 4,504,570 | 3/1985 | Evans et al. | 430/217 |
| 4,540,654 | 9/1985 | Sato et al. | 430/381 |
| 4,755,455 | 7/1988 | Iwasa | 430/558 |

*Primary Examiner*—Paul R. Michl
*Assistant Examiner*—Lee C. Wright
*Attorney, Agent, or Firm*—Sughrue, Mion, Zinn, Macpeak & Seas

[57] ABSTRACT

A silver halide color photographic material comprising a support having thereon a blue-sensitive silver halide emulsion layer, a green-sensitive silver halide emulsion layer and a red-sensitive silver halide emulsion layer, wherein the silver halide color photographic material contains at least one kind of pyrazoloazole type magenta coupler represented by the general formula (I) described below and the total coating amount of silver in the photographic material is 0.75 g/m$^2$ or less.

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za-Zb bond and the Zb-Zc bond being a double bond and the other being a single bond; when the Zb-Zc bond is a carbon-carbon double bond, the Zb-Zc bond may be a part of a condensed aromatic ring; $R^1$ or X may also form a polymer including a dimer or more; and when Za, Zb or Zc is a substituted methine group, the substituted methine group may form a polymer including a dimer or more.

The silver halide color photographic material provides color images having improved color reproducibility and preservability and is excellent in processing stability.

14 Claims, No Drawings

SILVER HALIDE COLOR PHOTOGRAPHIC MATERIAL

FIELD OF THE INVENTION

The present invention relates to a silver halide color photographic material and more specifically, to a silver halide color photographic material which has improved color reproducibility and image preservability and is excellent in processing stability.

BACKGROUND OF THE INVENTION

In general, a silver halide color photographic material comprises a support coated thereon three kinds of silver halide emulsion layers which are selectively sensitized so as to be sensitive to blue light, green light and red light respectively, in the form of a multilayer structure.

In order to form a color photographic image, a silver halide color photographic material containing three color photographic couplers of yellow, magenta and cyan incorporated into the light-sensitive emulsion layers respectively is exposed imagewise and then subjected to color development processing using a color developing agent such as an aromatic primary amine. The oxidation product of an aromatic primary amine reacts with a coupler to form a dye. It is preferred that the coupler used has a good color forming property. Specifically, the coupler is desired to have a large coupling speed as possible in order to provide a high color density within a restricted developing time. Further, it is requested that dyes formed are clear cyan, magenta and yellow dyes each having less subsidiary absorption and provide a color photographic image having good color reproducibility.

On the other hand, it is also requested for color photographic images formed to have good preservability under various conditions. Such conditions for preservation include, for example, condition for preservation in a dark place influenced by humidity or heat and condition for preservation under light irradiation such as sun light, room light, etc. In addition to discoloration and fading of color images, yellowing of white background is severe problem, in particular, in color photographic materials for prints.

In order to fulfill the above-described requirements for color photographic materials, couplers play an important role as color image formers. Therefore, various investigations for improving these properties have been made by modifying coupler structures. Particularly, magenta couplers are important from the standpoint of visual sensitivity and 5-pyrazolone derivatives have been heretofore employed mainly as magenta couplers. However, color images formed therefrom have undesirable absorptions in a blue light region and a red light region in addition to desired absorption in a green light region, and thus it can not be said that these magenta couplers have satisfactory properties. Further, 5-pyrazolone derivatives are insufficient in view of image preservability since they are apt to change to yellow under light irradiation or a condition of high humidity, although they are excellent in processing stability.

On the other hand, pyrazoloazole type magenta couplers as described in Japanese Patent Application (OPI) No. 171956/84, etc. (the term "OPI" as used herein means an "unexamined published application") have superior properties in that they are excellent in light absorption characteristics of color images formed therefrom and that they provide less yellowing in white background.

However, with pyrazoloazole type magenta couplers, color density is widely changed depending on the variations in color development processing solutions. Particularly, these changes in color density are considerably large and cause severe problems in practical use in a case wherein an amount of the photographic material processed per day is varied or wherein silver chloride, silver bromide or silver chlorobromide, which do not substantially contain silver iodide is employed as silver halide.

SUMMARY OF THE INVENTION

Therefore, a general object of the present invention is to provide a color photographic light-sensitive material which fulfills at the same time the above-described properties required to a color photographic light-sensitive material.

More specifically, an object of the present invention is to provide a color photographic light-sensitive material which is excellent in color reproducibility by providing a magenta color image having a good light absorption characteristic.

Another object of the present invention is to provide a color photographic light-sensitive material which provides an image having good fastness and reduced stain in white background upon preservation in a dark place and under light irradiation.

A further object of the present invention is to provide a color photographic light-sensitive material with which the change in color density depending on variations of development processing solutions is small and which has good processing stability.

Other objects of the present invention will become apparent from the following detailed description and examples.

These objects of the present invention can be accomplished by a silver halide color photographic material comprising a support having thereon a blue-sensitive silver halide emulsion layer, a green-sensitive silver halide emulsion layer and a red-sensitive silver halide emulsion layer, wherein the silver halide color photographic material contains at least one kind of pyrazoloazole type magenta coupler represented by the general formula (I) described below and the total coating amount of silver in the photographic material is 0.75 $g/m^2$ or less.

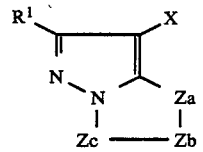

(I)

wherein $R^1$ represents a hydrogen atom or a substituent; X represents a hydrogen atom or a group capable of being released upon a coupling reaction with an oxidation product of an aromatic primary amine developing agent; Za, Zb and Zc each represents a methine group, a substituted methine group, =N— or —NH—, one of the Za-Zb bond and the Zb-Zc bond being a double bond and the other being a single bond; when the Zb-Zc bond is a carbon-carbon double bond, the Zb-Zc bond may be a part of a condensed aromatic ring; $R^1$ or X may also form a polymer including a dimer or more;

and when Za, Zb or Zc is a substituted methine group, the substituted methine group may form a polymer including a dimer or more.

DETAILED DESCRIPTION OF THE INVENTION

The compound which can be employed in the present invention will be described in detail in the following.

The term "polymer" as used with respect to the compound represented by the general formula (I) means a compound containing at least two groups derived from the compound represented by the general formula (I) in its molecule, and includes a bis coupler and a polymer coupler. The polymer coupler may be either a homopolymer composed of only a monomer having a moiety represented by the general formula (I) (preferably a monomer having a vinyl group, hereinafter referred to as a vinyl monomer) or a copolymer composed of a vinyl monomer described above and a non-color forming ethylenic monomer which does not undergo coupling with the oxidation product of an aromatic primary amine developing agent.

Of the pyrazoloazole type magenta couplers represented by the general formula (I), preferred couplers are those represented by the following general formula (II), (III), (IV), (V), (VI), (VII) or (VIII):

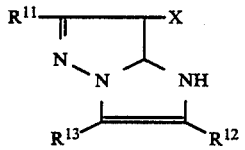
(II)

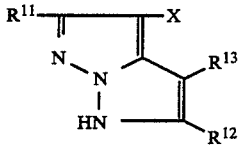
(III)

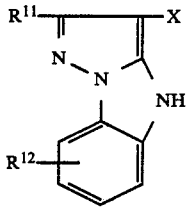
(IV)

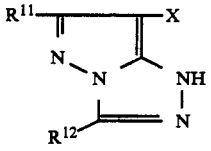
(V)

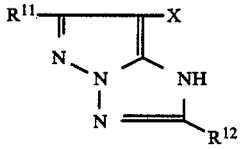
(VI)

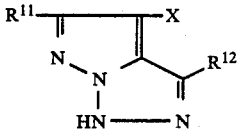
(VII)

-continued

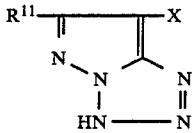
(VIII)

In the general formula (II), (III), (IV), (V), (VI), (VII) or (VIII), $R^{11}$, $R^{12}$ and $R^{13}$, which may be the same or different, each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, a imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or aryloxycarbonyl group and X represents a hydrogen atom, a halogen atom, a carboxy group or a group capable of being released upon coupling which is bonded to the carbon atom at the coupling position through an oxygen atom, a nitrogen atom or a sulfur atom. Also, $R^{11}$, $R^{12}$, $R^{13}$ or X may be a divalent group to form a bis coupler. Further, the coupler represented by the general formula (II), (III), (IV), (V), (VI), (VII) or (VIII) may be in the form of a polymer coupler in which the coupler moiety exists at the main chain or the side chain of the polymer and particularly a polymer coupler derived from a vinyl monomer having the coupler moiety represented by the general formulae (II) to (VIII) described above is preferred. In this case, $R^{11}$, $R^{12}$, $R^{13}$ or X represents a vinyl group or a linking group.

In more detail, $R^{11}$, $R^{12}$ and $R^{13}$ each represents a hydrogen atom, a halogen atom (e.g., a chlorine atom, a bromine atom, etc.), an alkyl group (e.g., a methyl group, a propyl group, an isopropyl group, a tert-butyl group, a trifluoromethyl group, a tridecyl group, a 2-{α-[3-(2-octyloxy-5-tert-octylbenzenesulfonamido)-phenoxy]tetradecanamido}ethyl group, a 3-(2,4-di-tert-amylphenoy)propyl group, an allyl group, a 2-dodecyloxyethyl group, a 1-(2-octyloxy-5-tert-octylbenzenesulfonamido)-2-propyl group, a 1-ethyl-1-[4-(2-butoxy-5-tert-octylbenzenesulfonamido)phenyl]methyl group, a 3-phenoxypropyl group, a 2-hexylsulfonylethyl group, a cyclopentyl group, a benzyl group, etc.), an aryl group (e.g., a phenyl group, a 4-tert-butylphenyl group, a 2,4-di-tert-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a 2-methanesulfonylethoxy group, etc.), an aryloxy group (e.g., a phenoxy group, a 2-methylphenoxy group, a 4-tert-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-tert-amylphenoxy)-butylamido group, a γ-(3-tert-butyl-4-hydroxyphenoxy)butylamido group, an α-[4-(4-hydroxyphenylsulfonyl)phenoxy]decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-[α-(3-tert-butyl-4-hydroxyphenoxy)dodecanamido]-anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropyl-sulfamoylamino group, an N-methyldecylsulfamoylamino group, etc.), an alkylthio group (e.g., a methylthio group, an octylthio group, a tetradecylthio group, a 2-phenoxyethylthio group, a 3-phenoxypropylthio group, a 3-(4-tert-butylphenoxy)propylthio group, etc.), an arylthio group (e.g., a phenylthio group, a 2-butoxy-5-tert-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-di-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-tert-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-[3-(2,4-di-tert-amylphenoxy)propyl]carbamoyl group, etc.), an acyl group (e.g., an acetyl group, a (2,4-di-tert-amylphenoxy)acetyl group, a benzoyl group, etc.), a sulfamoyl group (e.g., an N-ethylsulfamoyl group, an N,N-dipropylsulfamoyl group, an N-(2-dodecyloxyethyl) sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), an sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.) or an aryloxycarbonyl group (e.g., a phenyloxycarbonyl group, a 3-pentadecylphenyloxycarbonyl group, etc.); and X represents a hydrogen atom; a halogen atom (e.g., a chlorine atom, a bromine atom, an iodine atom, etc.); a carboxy group; a group bonded to the coupling position through an oxygen atom (e.g., an acetoxy group, a propanoyloxy group, a benzoyloxy group, a 2,4-dichlorobenzoyloxy group, an ethoxyoxazoyloxy group, a pyruvoyloxy group, a cinnamoyloxy group, a phenoxy group, a 4-cyanophenoxyl group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenetyloxy group, a 2-phenoxyethoxy group, a 5-phenyltetrazolyloxy group, a 2-benzothiazolyloxy group, etc.); a group bonded to the coupling position through a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzyl-5-ethoxy-3-hydantoinyl group, a 2N-1,1-dioxo-3-(2H)-oxo-1,2-benzisothiazoylyl group, a 2-oxo-1,2-dihydro-1-pyridinyl group, an imidazolyl group, a pyrazolyl group, a 3,5-diethyl-1,2,4-triazol-1-yl group, a 5- or 6-bromobenzotriazol-1-yl group, a 5-methyl-1,2,3,4-triazol-1-yl group, a benzimidazolyl group, a 3-benzyl-1-hydantoinyl group, a 1-benzyl-5-hexadecyloxy-3-hydantoinyl group, a 5-methyl-1-tetrazolyl group, etc.); an arylazo group (e.g., a 4-methoxyphenylazo group, a 4pivaloylaminophenylazo group, a 2-naphthylazo group, a 3-methyl-4-hydroxyphenylazo group etc.); or a group bonded to the coupling position through a sulfur atom (e.g., a phenylthio group, a 2-carboxyphenylthio group, a 2-methoxy-5-tert-octylphenylthio group, 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

In the coupler represented by the general formula (II) or (III), $R^{12}$ and $R^{13}$ may combine with each other to form a 5-membered, 6-membered or 7-membered ring.

When $R^{11}$, $R^{12}$, $R^{13}$ or X represents a divalent group to form a bis coupler, $R^{11}$, or $R^{12}$ or $R^{13}$ preferably represents a substituted or unsubstituted alkylene group (e.g., a methylene group, an ethylene group, a 1,10-decylene group, $—CH_2CH_2—O—CH_2CH_2—$, etc.), a substituted or unsubstituted phenylene group (e.g., a 1,4-phenylene group, a 1,3-phenylene group,

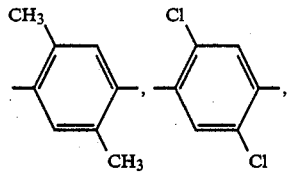

etc.), an $—NHCO—R^{14}—CONH—$ group (wherein $R^{14}$ represents a substituted or unsubstituted alkylene or phenylene group, e.g., $—NHCOCH_2CH_2CONH—$,

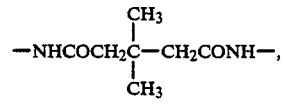

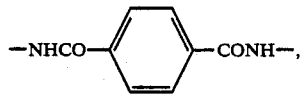

etc.) or an $—S—R^{14}—S—$ group (wherein $R^{14}$ represents a substituted or unsubstituted alkylene group, e.g., $—S—CH_2CH_2—S—$,

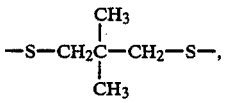

etc.); X represents a divalent group appropriately formed from the monovalent group for X described above.

The linking group represented by $R^{11}$, $R^{12}$, $R^{13}$ or X in the cases wherein the coupler moiety represented by the general formula (II), (III), (IV), (V), (VI), (VII) or (VIII) is included in a vinyl monomer includes an alkylene group (including a substituted or unsubstituted alkylene group, e.g., a methylene group, an ethylene group, a 1,10-decylene group $-CH_2CH_2OCH_2CH_2-$, etc.), a phenylene group (including a substituted or unsubstituted phenylene group, e.g., a 1,4-phenylene group, a 1,3-phenylene group,

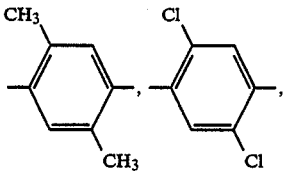

etc), —NHCO—, —CONH—, —O—, —OCO—, and an aralkylene group (e.g.,

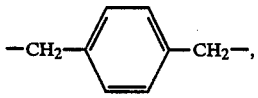

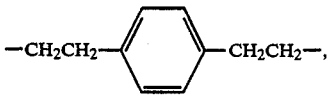

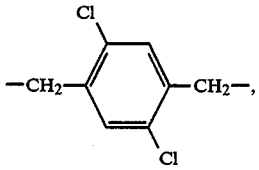

etc.) or a combination thereof.

Specific examples of preferred linking groups are set forth below.

—NHCO—, $-CH_2CH_2-$,

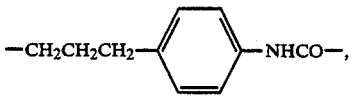

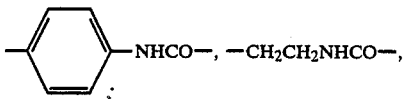

$-CH_2CH_2-O-C-$, $-CONHCH_2CH_2NHCO-$, $-CH_2CH_2OCH_2CH_2-NHCO-$,

-continued

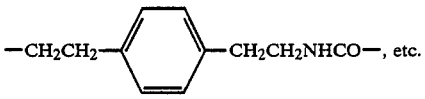

Further, a vinyl group in the vinyl monomer may further have a substituent in addition to the coupler moiety represented by general formula (II), (III), (IV), (V), (VI), (VII) or (VIII). Preferred examples of the substituents include a hydrogen atom, a chlorine atom or a lower alkyl group having from 1 to 4 carbon atoms (e.g., a methyl group, an ethyl group, etc.).

Among the couplers represented by the general formula (II), (III), (IV), (V), (VI), (VII) or (VIII), the couplers represented by the general formula (II), (V) or (VI) are preferred for the purpose of the present invention. Further, the couplers represented by the general formula (V) or (VI) are particularly preferred.

A monomer containing the coupler moiety represented by the general formula (II), (III), (IV), (V), (VI), (VII) or (VIII) may form a copolymer together with a non-color forming ethylenic monomer which does not undergo coupling with the oxidation product of an aromatic primary amine developing agent.

Examples of non-color forming ethylenic monomers which do not undergo coupling with the oxidation product of an aromatic primary amine developing agent include an acrylic acid (such as acrylic acid, α-chloroacrylic acid, an α-alkylacrylic acid (e.g., methacrylic acid, etc.), an ester or an amide derived from an acrylic acid (e.g., acrylamide, n-butylacrylamide, tert-butylacrylamide, diacetoneacrylamide, methacrylamide, methyl acrylate, ethyl acrylate, n-propyl acrylate, n-butyl acrylate, tert-butyl acrylate, isobutyl acrylate, 2-ethylhexyl acrylate, n-octyl acrylate, lauryl acrylate, methyl methacrylate, ethyl methacrylate, n-butyl methacrylate, β-hydroxy methacrylate, etc.), methylenedibisacrylamide, a vinyl ester (e.g., vinyl acetate, vinyl propionate, vinyl laurate, etc.), acrylonitrile, methacrylonitrile, an aromatic vinyl compound (e.g., styrene and a derivative thereof, vinyltoluene, divinylbenzene, vinylacetophenone, sulfostyrene, etc.), itaconic acid, citraconic acid, crotonic acid, vinylidene chloride, a vinyl alkyl ether (e.g., vinyl ethyl ether, etc.), maleic acid, maleic anhydride, a maleic acid ester, N-vinyl-2-pyrrolidone, N-vinylpyridine, 2- or 4-vinylpyridine, etc.

Two or more kinds of non-color forming ethylenically unsaturated monomers can be used together. For example, a combination of n-butyl acrylate and methyl acrylate, styrene and methacrylic acid, methacrylic acid and acrylamide, methyl acrylate and diacetoneacrylamide, etc., can be used.

As is well known in the field of polymer color couplers, the non-color forming ethylenically unsaturated monomer which is copolymerized with a solid water-insoluble monomer coupler can be selected in such a manner that the copolymer formed has good physical properties and/or chemical properties, for example, solubility, compatibility with a binder in a photographic colloid composition, such as gelatin, flexibility, heat stability, etc.

The polymer couplers used in the present invention may be water-soluble coupler or water-insoluble couplers, but polymer coupler latexes are particularly preferred as such polymer couplers.

Specific examples of the pyrazoloazole type magenta couplers represented by the general formula (I) which can be used in the present invention and methods for syntheses thereof are described, for example, in Japanese Patent Application (OPI) Nos. 162548/84, 43659/85, 171956/84 and 33552/85, Japanese Patent Application No. 172982/85, and U.S. Pat. No. 3,061,432, etc.

In order to achieve the objects of the present invention, it is preferred that the coating amount of silver in a silver halide emulsion (typically, a green-sensitive silver halide emulsion) which is employed in combination with the pyrazoloazole type magenta coupler represented by the above-described general formula (I) is 5 mols or less per mol of the coupler (that is, a silver/coupler ratio being 5 or less). Further it is more preferred that the total coating amount of silver in the photographic material is 0.70 g/m$^2$ or less and the coating amount of silver in a silver halide emulsion which is employed in combination with the pyrazoloazole type magenta coupler is 4 moles or less per mol of the coupler (that is, a silver/coupler ratio being 4 or less).

Of the couplers represented by the general formula (I), it is preferred to employ those represented by the general formula (Va) or (VIa) described below and particularly preferred to employ the latter.

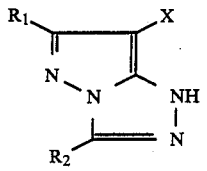
(Va)

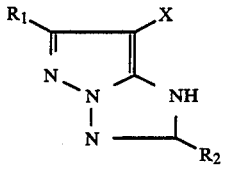
(VIa)

wherein $R_1$ and X each has the same meaning as defined in the general formula (I); $R_2$ represents a ballast group.

The ballast group represented by $R_2$ is a group sufficient to render the coupler immobile in a photographic emulsion layer and usually containing 8 or more carbon atoms, as well known to one skilled in the art.

Of the couplers represented by the general formula (Va) or (VIa), those wherein at least one of $R_1$ and $R_2$ is a group connected to the pyrazolotriazole ring through a secondary or tertiary carbon atom and at least one of $R_1$ and $R_2$ is a group containing a —$NHSO_2$— group are particularly preferred to use.

Specific examples of representative magenta couplers and vinyl monomers for preparing polymer couplers according to the present invention are set forth below, but the present invention should not be construed as being limited thereto.

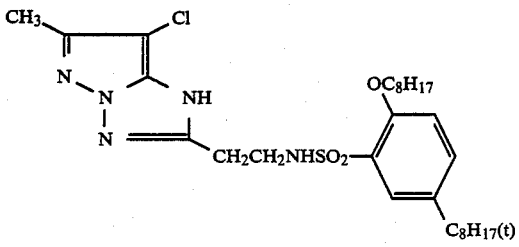
M-1

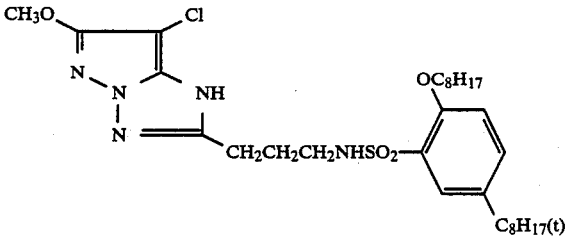
M-2

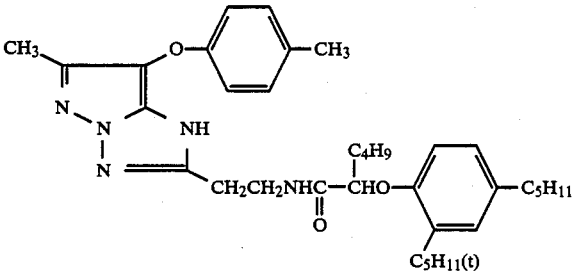
M-3

-continued
M-4
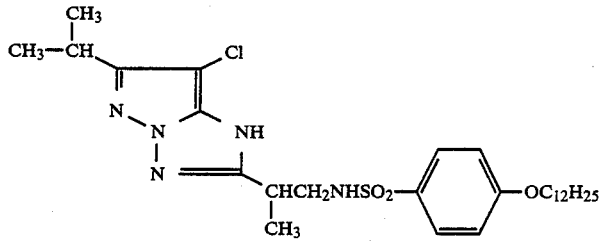
M-5
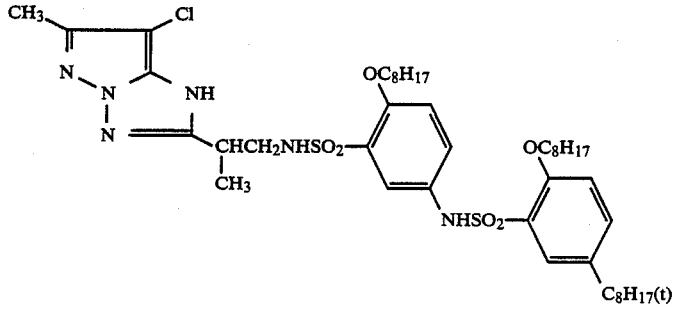
M-6
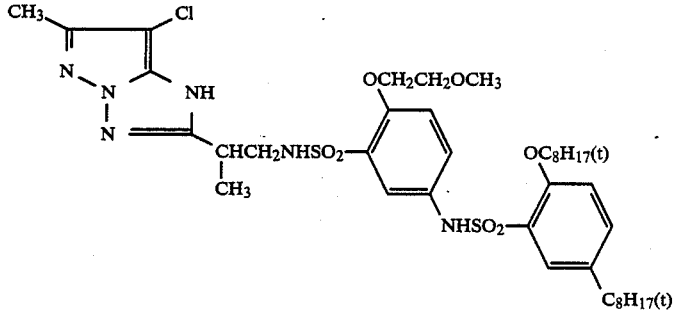
M-7
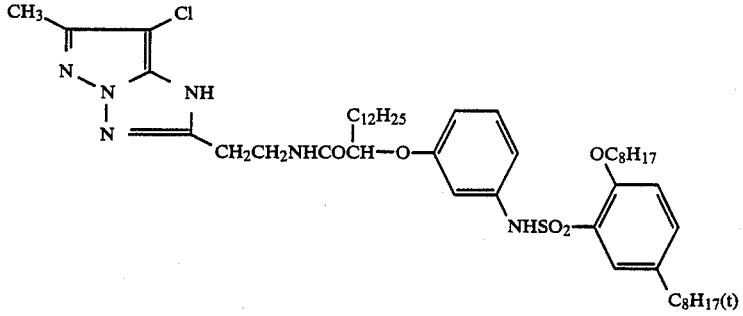
M-8
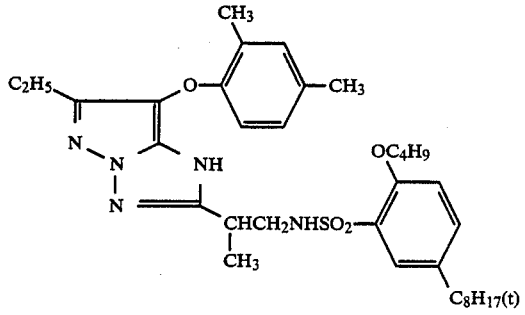

-continued
M-9
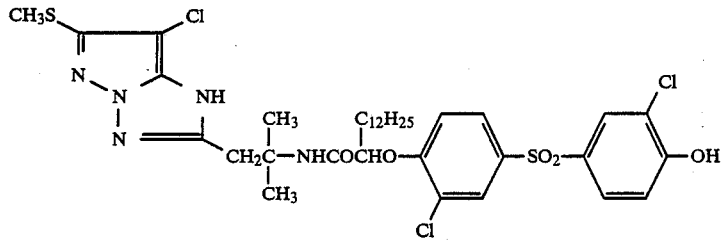
M-10
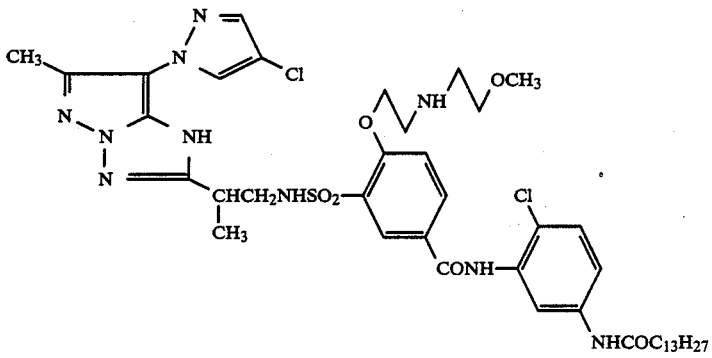
M-11
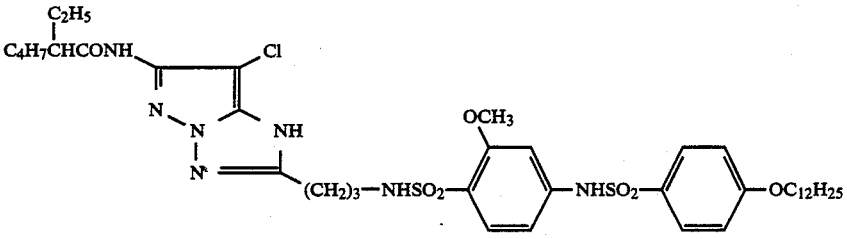
M-12
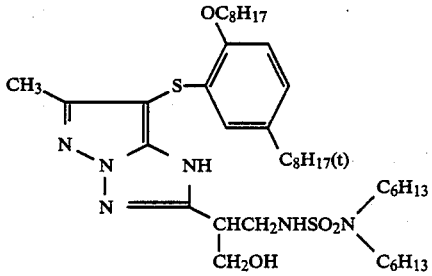
M-13
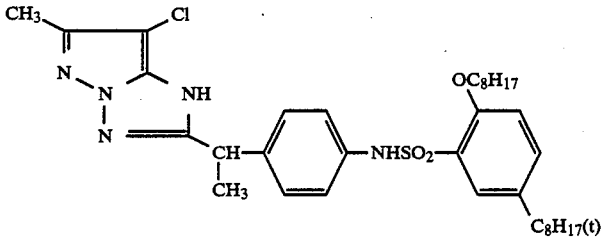
M-14
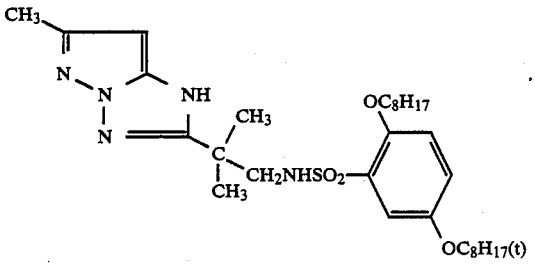

-continued
M-15
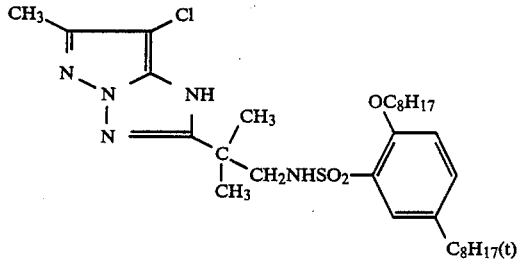
M-16
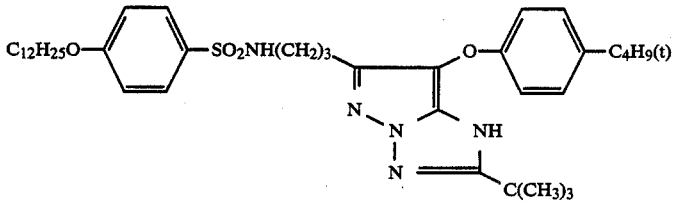
M-17
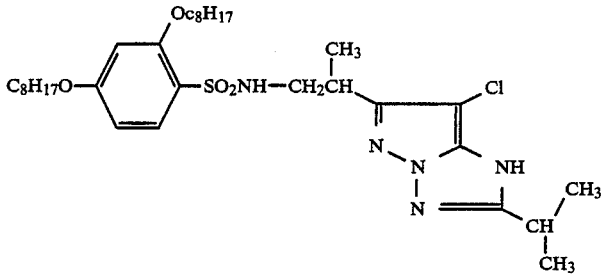
M-18
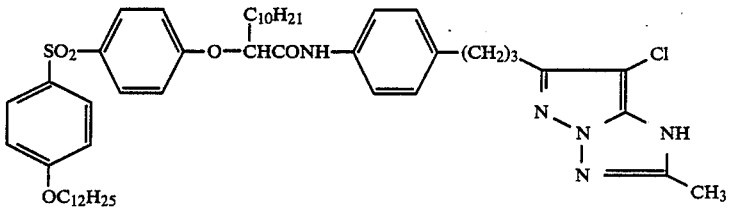
M-19
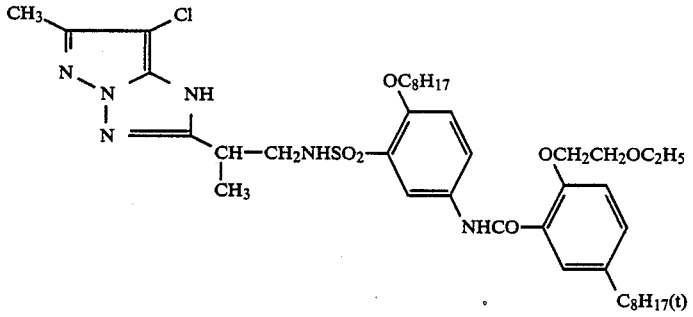
M-20
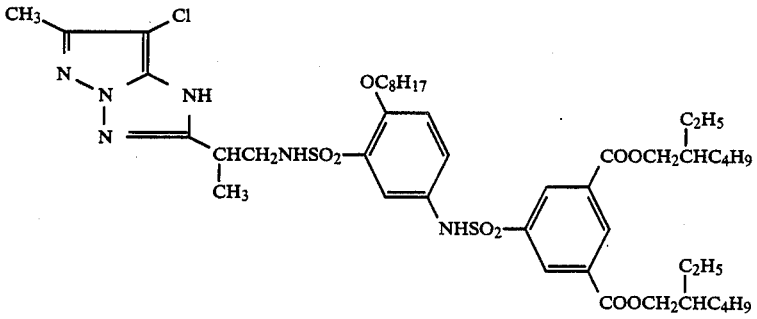

-continued
M-21
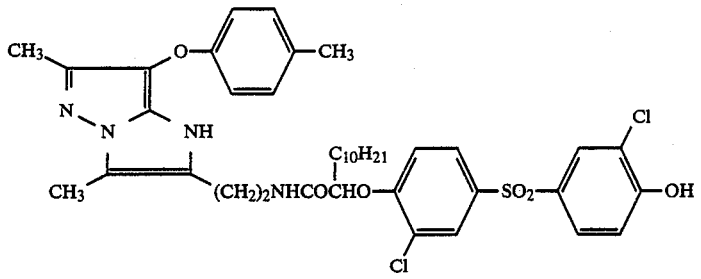
M-22
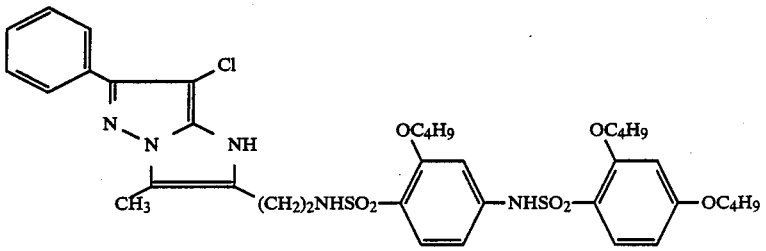
M-23
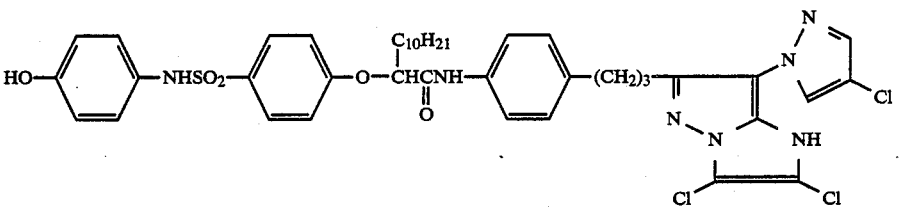
M-24
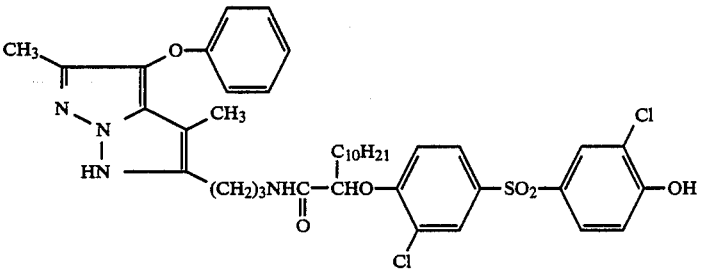
M-25
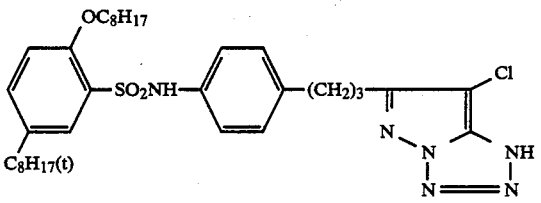
M-26
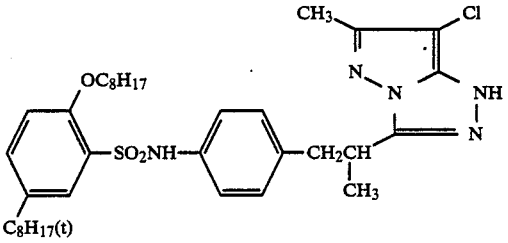

-continued
M-27
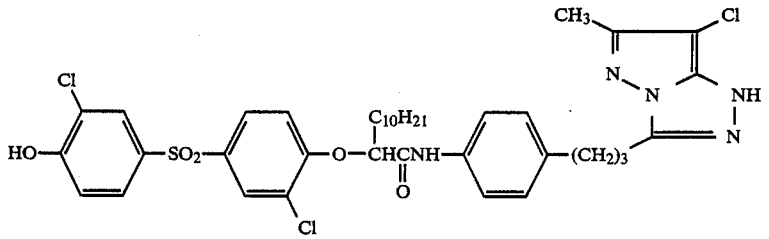
M-28
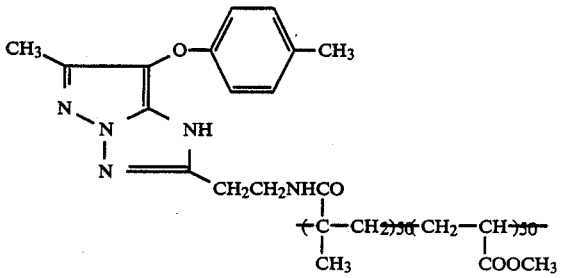
M-29
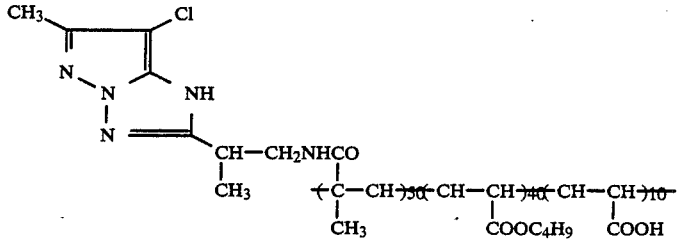
M-30
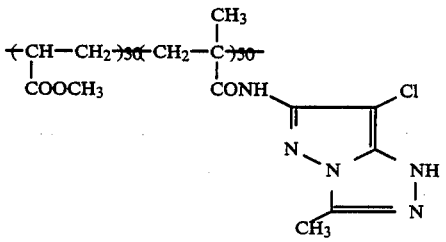
M-31
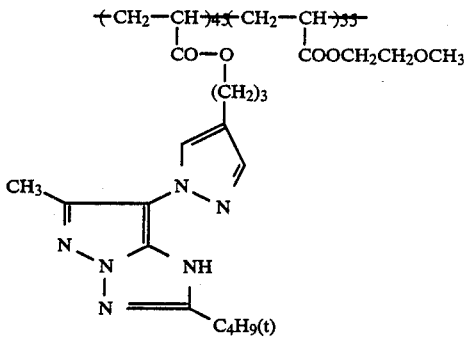
M-32
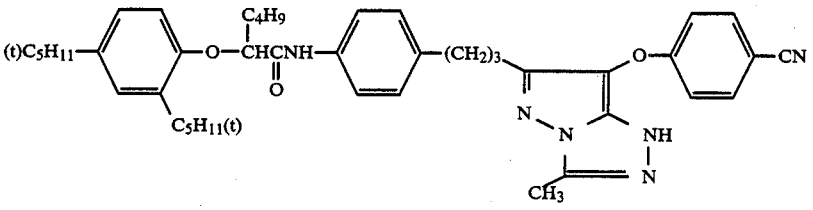

-continued
M-33
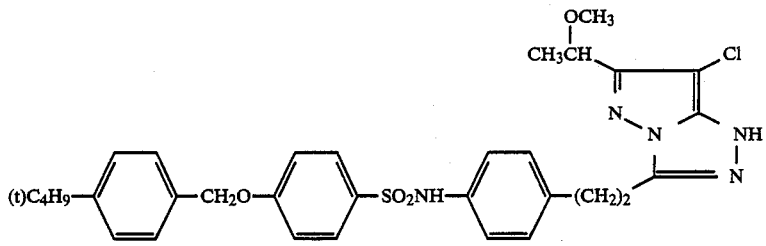
M-34
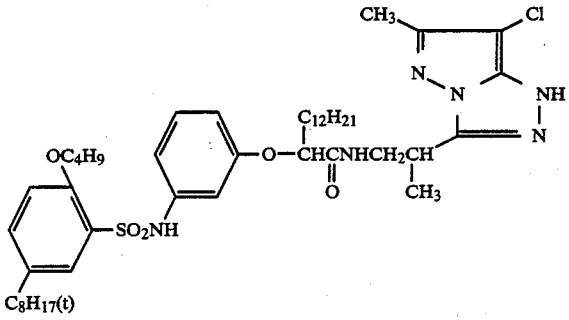
M-35
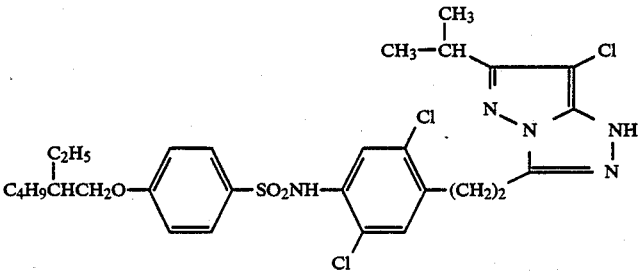
M-36
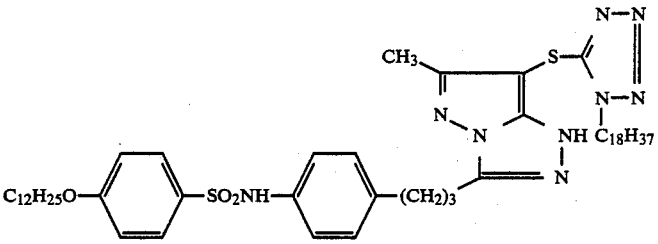
M-37
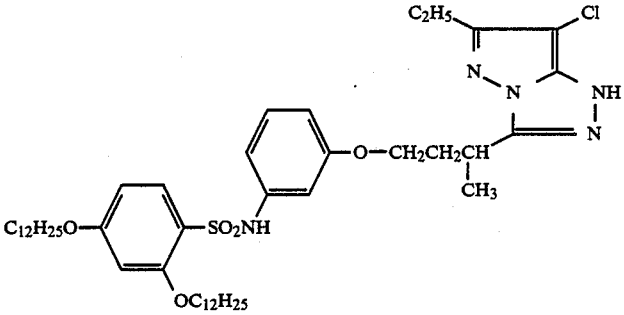

-continued
M-38
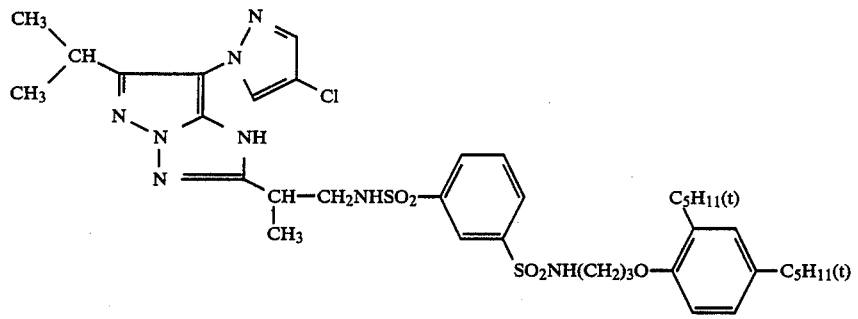
M-39
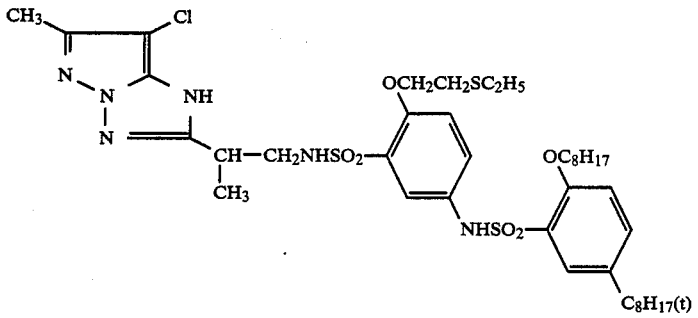
M-40
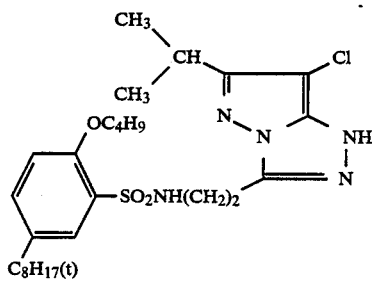
M-41
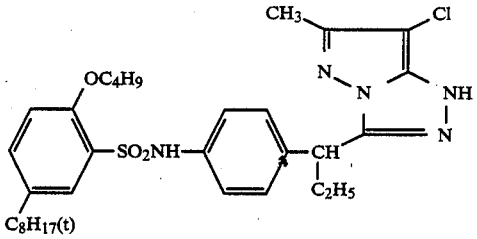
M-42
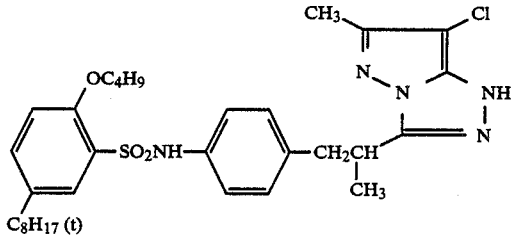

-continued

M-43

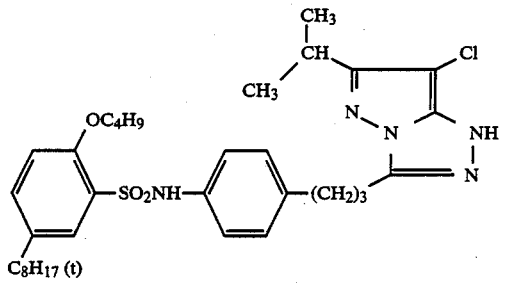

In the silver halide color photographic material of the present invention, a cyan coupler and a yellow coupler are employed in addition to the above-described magenta coupler.

Typical examples of these color couplers include naphthol or phenol type compounds and open-chain or heterocyclic keto-methylene type compounds. Specific examples of utilizable cyan and yellow couplers in the present invention are described in the patents cited in *Research Disclosure,* No. 17643, VII-D (December 1978) and ibid., No. 18717 (November 1979).

It is preferable that color couplers which are incorporated into the photographic light-sensitive material are diffusion resistant by means of containing a ballast group or polymerizing. Further, two-equivalent color couplers the coupling active position of which is substituted with a group capable of being released are preferred in comparison with four-equivalent color couplers the coupling active position of which is substituted with a hydrogen atom since the coating amount of silver is reduced. Also couplers which form colored dyes having an appropriate diffusibility, non-color forming couplers, or couplers capable of releasing development inhibitors (DIR couplers) or development accelerators accompanying the coupling reaction can be employed.

As typical yellow couplers used together in the present invention, oil protected acylacetamide type couplers are exemplified. Specific examples thereof are described in U.S. Pat. Nos. 2,407,210, 2,875,057 and 3,265,506, etc. In the present invention, two-equivalent yellow couplers are preferably employed and typical examples thereof include yellow couplers of oxygen atom releasing type as described in U.S. Pat. Nos. 3,408,194, 3,447,928, 3,933,501 and 4,022,620, etc. and yellow couplers of nitrogen atom releasing type as described in Japanese Patent Publication No. 10739/83, U.S. Pat. Nos. 4,401,752 and 4,326,024, *Research Disclosure,* No. 18053 (April, 1979), British Pat. No. 1,425,020, West German Patent Application (OLS) Nos. 2,219,917, 2,261,361, 2,329,587 and 2,433,812, etc. α-Pivaloylacetanilide type couplers are characterized by excellent fastness, particularly light fastness of dyes formed, and α-benzoylacetanilide type couplers are characterized by providing high color density.

As cyan couplers used together in the present invention, oil protected naphthol type and phenol type couplers are exemplified. Typical examples thereof include naphthol type couplers as described in U.S. Pat. No. 2,474,293 and preferably oxygen atom releasing type, two-equivalent naphthol type couplers as described in U.S. Pat. Nos. 4,052,212, 4,146,396, 4,228,233 and 4,296,200, etc. Specific examples of phenol type couplers are described in U.S. Pat. Nos. 2,369,929, 2,801,171, 2,772,162 and 2,895,826, etc.

Cyan couplers fast to humidity and temperature are preferably used in the present invention. Typical examples thereof include phenol type cyan couplers having an alkyl group more than a methyl group at the metha-position of the phenol nucleus as described in U.S. Pat. No. 3,772,002, 2,5-diacylamino-substituted phenol type couplers as described in U.S. Pat. Nos. 2,772,162, 3,758,308, 4,126,396, 4,334,011 and 4,327,173, West German Patent Application (OLS) No. 3,329,729 and Japanese Patent Application (OPI) No. 166956/84, etc. and phenol type couplers having a phenyl ureido group at the 2-position thereof and an acylamino group at the 5-position thereof as described in U.S. Pat. Nos. 3,446,622, 4,333,999, 4,451,559 and 4,427,767, etc.

Two or more kinds of various couplers used in the present invention described above can be incorporated together in the same layer for the purpose of satisfying the properties required to the photographic light-sensitive materials, or the same compound can be added to different two or more layers.

The couplers which can be used in the present invention can be incorporated into photographic light-sensitive materials using various known dispersing methods. Typical examples thereof include a solid dispersing method, an alkali dispersing method, preferably a latex dispersing method and more preferably an oil droplet in water type dispersing method. By means of the oil droplet in water type dispersing method, couplers are dissolved in either an organic solvent having a high boiling point of 175° C. or more, an auxiliary solvent having a low boiling point, or a mixture thereof and then the solution is finely dispersed in an aqueous medium such as water or an aqueous gelatin solution, etc. in the presence of a surface active agent. Specific examples of the organic solvents having a high boiling point are described in U.S. Pat. No. 2,322,027, etc.

A standard amount of coupler to be used is in a range from 0.001 mol to 1 mol per mol of a light-sensitive silver halide. It is preferred to add 0.01 mol to 0.5 mol of a yellow coupler and 0.002 mol to 0.3 mol of a cyan coupler per mol of silver halide.

The silver halide emulsion which is used in the present invention is usually prepared by mixing an aqueous solution of a water-soluble silver salt (for example, silver nitrate) with an aqueous solution of a water-soluble halide solution (for example, potassium bromide, sodium chloride, potassium iodide or a mixture thereof) in the presence of an aqueous solution of a water-soluble polymer (for example, gelatin, etc.).

Silver halide grains may have different layers in the inner portion and the surface portion, multiphase structures containing junctions or may be uniform throughout the grains. Further, a mixture of these silver halide grains having different structures may be employed. For instance, with respect to silver chlorobromide grains having different phases, those having nuclei which are rich in silver bromide as compared with the mean halogen composition or a single layer or plural layers, or those having nuclei which are rich in silver chloride as compared with the mean halogen composition or a single layer or plural layers are exemplified.

Average grain size of silver halide grains (the grain size being defined as grain diameter if the grain has a spherical or a nearly spherical form and as a length of the edge if the grain has a cubic form, and being averaged based on projected areas of the grains). is preferably from 0.1μ to 2μ, and particularly from 0.15μ to 1μ. Grain size distribution may be either narrow or broad.

A so-called mono-dispersed silver halide emulsion can be employed in the present invention. The degree of mono-dispersity is indicated using a value, i.e., a coefficient of variation, which is obtained by dividing a standard deviation derived from grain size distribution curve of silver halide by an average grain size, and the coefficient of variation is preferably 15% or less and particularly 10% or less. Further, in order to achieve the desired gradation of the light-sensitive material, two or more mono-dispersed silver halide emulsions which have different grain sizes from each other can be mixed in one emulsion layer or can be coated in the form of superimposed layers which have substantially same spectral sensitivity. Moreover, two or more poly-dispersed silver halide emulsions or combinations of a mono-dispersed emulsion and a polydispersed emulsion may be employed in a mixture or in the form of superimposed layers.

Silver halide grains which can be used in the present invention may have a regular crystal structure, for example, a cubic, octahedral, dodecahedral or tetradecahedral structure, etc., an irregular crystal structure, for example, a spherical structure, etc., or a composite structure thereof. Further, tabular silver halide grains can be used. Particularly, a silver halide emulsion wherein tabular silver halide grains having a ratio of diameter/thickness of not less than 5, preferably not less than 8 are account for at least 50% of the total projected area of the silver halide grains present can be employed. In addition, mixtures of silver halide grains having different crystal structures may be used. These silver halide emulsions may be those of surface latent image type in which latent images are formed mainly on the surface thereof, those of internal latent image type in which latent images are formed mainly in the interior thereof.

Photographic emulsions as used in the present invention can be prepared in any suitable manner, for example, by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide grains are formed in the presence of an excess of silver ions. A conversion method wherein a halogen salt which can form more insoluble silver halide is added may also be used. As one system of the double jet process, a so-called controlled double jet process in which the pAg in a liquid phase where silver halide is formed is maintained at a predetermined level can be employed. This process can prepare a silver halide emulsion in which the crystal form is regular and the particle size is nearly uniform.

During the step of formation or physical ripening of silver halide grains, cadmium salts, zinc salts, lead salts, thallium salts, iridium salts or complex salts thereof, rhodium salts or complex salts thereof, iron salts or complex salts thereof, etc. may be allowed to coexist.

After the formation of silver halide grains, silver halide emulsions are usually subjected to physical ripening, removal of soluble salts and chemical ripening and then employed for coating.

Known silver halide solvents (for example, ammonia, potassium thiocyanate, and thioethers and thione compounds as described in U.S. Patent 3,271,157, Japanese Patent Application (OPI) Nos. 12360/76, 82408/78, 144319/78, 100717/79 and 155828/79, etc.) can be employed during the step of formation, physical ripening or chemical ripening of silver halide.

For removal of soluble silver salts from the emulsion after physical ripening, a noodle washing process, a flocculation process or an ultrafiltration process, etc. can be employed.

The photographic emulsions as used in the present invention can be spectrally sensitized with methine dyes or other dyes, if desired.

In the photographic emulsion used in the present invention, various compounds can be incorporated for the purpose of preventing the formation of fog during the production, storage or processing of photographic light-sensitive materials or stabilizing the photographic properties of photographic light-sensitive materials.

The photographic light-sensitive material according to the present invention may contain hydroquinone derivatives, aminophenol derivatives, amines, gallic acid derivatives, catechol derivatives, ascorbic acid derivatives, non-color-forming couplers, sulfonamidophenol derivatives, etc., as color fog preventing agents or color mixing preventing agents.

In the photographic light-sensitive material of the present invention, various color fading preventing agents can be employed.

The photographic light-sensitive material of the present invention may contain an ultraviolet ray absorbing agent in a hydrophilic colloid layer thereof.

The photographic light-sensitive material of the present invention may contain one or more surface active agents as coating aids or for other various purposes, e.g., prevention of charging, improvement of slipping properties, acceleration of emulsification and dispersion, prevention of adhesion, and improvement of photographic characteristics (particularly development acceleration, high contrast, and sensitization), etc.

Moreover, into the photographic light-sensitive material according to the present invention can be incorporated various kinds of stabilizers, contamination preventing agents, developing agents or precursors thereof, development accelerating agents or precursor thereof, lubricants, mordants, matting agents, antistatic agents, plasticizers or other additives useful for photographic light-sensitive materials in addition to the above-described additives. Typical examples of these additives are described in Research Disclosure, No. 17643 (December, 1978) and ibid., No. 18716 (November, 1979).

The present invention is also applicable to a multilayer multicolor photographic material containing layers sensitive to at least two different spectral wavelength ranges on a support. A multi layer natural color photographic material generally possesses at least one red-sensitive silver halide emulsion layer, at least one green-sensitive silver halide emulsion layer and at least one blue-sensitive silver halide emulsion layer, respectively, on a support. The order of these light-sensitive layers can be varied and appropriately determined depending on demands. Further, each of the above described emulsion layers may be composed of two or more emulsion layers having different sensitivities. Moreover, between two or more emulsion layers having the same sensitivity, a light-insensitive layer may be present.

It is preferred in the photographic light-sensitive material according to the present invention that a subsidiary layer, for example, a protective layer. an intermediate layer, a filter layer, an antihalation layer, a back layer, etc. is appropriately provided in addition to the silver halide emulsion layer.

The photographic emulsion layers and other layers of the photographic light-sensitive material according to the present invention is coated on a flexible support such as a plastic film, paper or cloth, etc. or a rigid support such as glass, ceramic, metal, etc. usually used for photographic light-sensitive materials.

Preferred supports used in the present invention include baryta coated paper and paper laminated with polyethylene containing white pigments (for example, titanium oxide, etc.)

The silver halide color photographic material of the present invention is preferably employed for photographic light-sensitive materials for observing directly images such as color paper, color reversal paper, color reversal film, color positive films for cinematography, etc.

A color developing solution used for development processing of the photographic light-sensitive material of the present invention is preferably an alkaline aqueous solution containing an aromatic primary amine color developing agent as a main component. As a color developing agent, a p-phenylenediamine type compound is preferably used. Typical examples of the p-phenylenediamine type compounds include 3-methyl-4-amino-N,N-diethylaniline, 3-methyl-4-amino-N-ethyl-N-$\beta$-hydroxyethylaniline, 3-methyl-4-amino-N-ethyl-N-6-methanesulfonamidoethylaniline, 3-methyl-4-amino-N-ethyl-N-$\beta$-methoxyethylaniline, or a sulfate, hydrochloride or p-toluenesulfonate thereof, etc.

The color developing solution generally contains pH buffering agents such as carbonates, borates or phosphates of alkali metals, etc., development inhibitors or antifogging agents such as bromides, iodides, benzimidazoles, benzothiazoles or mercapto compounds, etc. In addition, if desired, the color developing solution may also contain organic solvents such as benzyl alcohol, diethylene glycol, etc., development accelerators such as polyethylene glycol, quaternary ammonium salts, amines, etc.

After color development, the photographic emulsion layer is usually subjected to a bleach processing. The bleach processing may be performed simultaneously with a fix processing, or they may be performed independently.

Bleaching agents which can be used include compounds of polyvalent metals, for example, iron (III), cobalt (III), chromium (VI), and copper (II), peracids, quinones and nitroso compounds. For example, ferricyanides; dichromates; organic complex salts of iron (III) or cobalt (III), for example, complex salts of aminopolycarboxylic acids (e.g., ethylenediaminetetraacetic acid, diethylenetriaminepentaacetic acid, nitrilotriacetic acid, 1,3-diamino-2-propanoltetraacetic acid, etc.) or organic acids (e.g., citric acid, tartaric acid, malic acid, etc.); persulfates; permanganates; nitrosophenol, etc. can be typically used. Of these compounds, iron (III) complex salts of ethylenediaminetetraacetic acid and persulfates are preferred in view of rapid processing and prevention from environmental pollution. Further, ethylenediaminetetraacetic acid iron (III) complex salts are particularly useful in both an independent bleaching solution and a mono-bath bleach-fixing solution.

In the bleaching solution or the bleach-fixing solution, various kinds of accelerators may be employed together, if desired.

After the bleach-fixing processing or the fixing processing, water washing processing is usually carried out. In the water washing step, various known compounds may be employed for the purpose of preventing precipitation or saving water, etc. For example, a water softener such as an inorganic phosphoric acid, an aminopolycarboxylic acid or an organic phosphoric acid, etc.; a sterilizer or antimold for preventing the propagation of various bacteria, algae and molds; a hardening agent such as a magnesium salt or an aluminium salt, etc.; or a surface active agent for reducing drying load or preventing drying marks, or the like may be added, if desired. Further, the compounds as described in L. E. West, "Water Quality Criteria" in *Photo. Sci. and Eng.*, Vol. 6, pages 344 to 359 (1965) may be added. Particularly, the addition of chelating agents and antimolds is effective.

The water washing step is ordinarily carried out using a countercurrent water washing processing with two or more tanks in order to save water. Further, in place of the water washing step, a multi-stage countercurrent stabilizing processing step as described in Japanese Patent Application (OPI) No. 8543/82 may be conducted. To the stabilizing bath various kinds of compounds are added for the purpose of stabilizing images formed. Representative examples of the additives include various buffers (for example, borates, methaborates, borax, phosphates, carbonates, potassium hydrooxide, sodium hydroxide, aqueous ammonia, monocarboxylic acids, dicarboxylic acids, polycarboxylic acids, etc. being used in combination) for the purpose of adjusting the pH of layers (for example, pH of 3 to 8), and formalin, etc. In addition, various additives, for example, water softeners (for example, inorganic phosphoric acids, aminopolycarboxylic acids, organic phosphoric acids, aminopolyphosphonic acids, phosphonocarboxylic acids, etc.), sterilizers (for example, benzoisothiazolinones, isothiazolones, 4-thiazolinebenzimidazoles, halogenated phenols, etc.), surface active agents, fluorescent whitening agents, hardening agents, etc. may be employed, if desired. Two or more compounds for the same or different purposes may be employed together.

Further, it is preferred to add various ammonium salts such as ammonium chloride, ammonium nitrate, ammonium sulfate, ammonium phosphate, ammonium sulfite, ammonium thiosulfate, etc., as pH adjusting agent for layers after processing.

For the purpose of simplification and acceleration of processing, a color developing agent may be incorporated into the silver halide color photographic material of the present invention. In order to incorporate the color developing agent, it is preferred to employ various precursors of color developing agents.

Further, the silver halide color photographic material of the present invention may contain various 1-phenyl-3-pyrazolidones for the purpose of accelerating color development, if desired. Typical examples of the compounds are described in Japanese Patent Application (OPI) Nos. 64339/81, 144547/82, 211147/82, 50532/83, 50536/83, 50533/83, 50534/83, 50535/83 and 115438/83, etc.

Various kinds of processing solutions are employed in a temperature range from 10° C. to 50° C. in the present invention. It is preferred to carry out development at a temperature range from 33° C. to 38° C.

Moreover, the photographic processing may be conducted utilizing color intensification using cobalt or hydrogen peroxide as described in West German Patent Application (OLS) No. 2,226,770 and U.S. Pat. No. 3,674,499, etc. for the purpose of saving an amount of silver employed in the photographic material.

In each of the processing baths, a heater, a temperature sensor, a liquid surface sensor, a circulation pomp, a filter, a floating cover, a squeezer, etc. may be provided, if desired.

The present invention is described in greater detail with reference to the following examples, but the present invention is not to be construed as being limited thereto.

EXAMPLE 1

On a paper support, both surfaces of which were laminated with polyethylene, a first layer (the undermost layer) to a seventh layer (the uppermost layer) were coated as shown in Table 1 below to prepare multilayer color photographic materials, Samples A to I.

The coating solution for the first layer of Sample A was prepared in the following manner.

100 g of a yellow coupler (*j) as shown in Table 1 below and 23.2 g of a color fading preventing agent (*k) were dissolved in a mixture of 44.3 ml of tri-isononyl phosphate and 200 ml of ethyl acetate and the resulting solution was dispersed in 800 g of a 10% aquecus solution of gelatin containing 80 ml of a 1% aqueous solution of sodium dodecylbenzenesulfonate. The dispersion thus obtained was mixed with 1,300 g of a blue-sensitive silver chlorobromide emulsion (bromide content: 80 mol%, silver content: 58.8 g) to prepare a coating solution.

With first layers of Samples B to I and other layers of Samples A to I, coating solutions were prepared in a similar manner to the above-described method.

2,4-Dichloro-6-hydroxy-s-triazine sodium salt was used in each of the layers as a hardening agent.

TABLE 1

| Layer | Composition | Sample A | B | C | D | E | F | G | H | I |
|---|---|---|---|---|---|---|---|---|---|---|
| Seventh Layer (Protective layer) | Acryl-modified polyvinyl alcohol copolymer (degree of modification: 17%)** | 0.17* | 0.17 | 0.17 | 0.17 | 0.17 | 0.17 | 0.17 | 0.17 | 0.17 |
| | Gelatin | 1.33 | 1.33 | 1.33 | 1.33 | 1.33 | 1.33 | 1.33 | 1.33 | 1.33 |
| Sixth Layer (Ultraviolet ray absorbing layer) | Ultraviolet ray absorbing agent | | | | | | | | | |
| | 1 *a | 0.15 | 0.15 | 0.15 | 0.15 | 0.15 | 0.15 | 0.15 | 0.15 | 0.15 |
| | 2 *b | 0.033 | 0.033 | 0.033 | 0.033 | 0.033 | 0.033 | 0.033 | 0.033 | 0.033 |
| | 3 *c | 0.15 | 0.15 | 0.15 | 0.15 | 0.15 | 0.15 | 0.15 | 0.15 | 0.15 |
| | Solvent *d | 0.12 | 0.12 | 0.12 | 0.12 | 0.12 | 0.12 | 0.12 | 0.12 | 0.12 |
| | Gelatin | 0.41 | 0.41 | 0.41 | 0.41 | 0.41 | 0.41 | 0.41 | 0.41 | 0.41 |
| Fifth Layer (Red-sensitive layer) | Silver chlorobromide emulsion (bromide content: 50 mol %) | 0.22 | 0.22 | 0.17 | 0.22 | 0.22 | 0.22 | 0.22 | 0.19 | 0.22 |
| | Cyan coupler 1 *e | 0.20 | 0.20 | 0.28 | 0.20 | 0.20 | 0.20 | 0.20 | 0.24 | 0.20 |
| | Cyan coupler 2 *f | 0.16 | 0.22 | 0.22 | 0.16 | 0.16 | 0.16 | 0.16 | 0.19 | 0.16 |
| | Ultraviolet absorbing agent 1 *a | 0.060 | 0.060 | 0.084 | 0.060 | 0.060 | 0.060 | 0.060 | 0.072 | 0.060 |
| | Ultraviolet absorbing agent 2 *b | 0.067 | 0.067 | 0.094 | 0.067 | 0.067 | 0.067 | 0.067 | 0.080 | 0.067 |
| | Ultraviolet absorbing agent 3 *c | 0.069 | 0.069 | 0.097 | 0.069 | 0.069 | 0.069 | 0.069 | 0.083 | 0.069 |
| | Solvent *g | 0.20 | 0.20 | 0.28 | 0.20 | 0.20 | 0.20 | 0.20 | 0.24 | 0.20 |
| | Gelatin | 1.60 | 1.60 | 1.60 | 1.60 | 1.60 | 1.60 | 1.60 | 1.60 | 1.60 |
| Fourth Layer (Color mixing preventing layer) | Ultraviolet ray absorbing agent | | | | | | | | | |
| | 1 *a | 0.30 | 0.30 | 0.30 | 0.30 | 0.30 | 0.30 | 0.30 | 0.30 | 0.30 |
| | 2 *b | 0.066 | 0.066 | 0.066 | 0.066 | 0.066 | 0.066 | 0.066 | 0.066 | 0.066 |
| | 3 *c | 0.30 | 0.30 | 0.30 | 0.30 | 0.30 | 0.30 | 0.30 | 0.30 | 0.30 |
| | Color mixing preventing agent *h | 0.053 | 0.053 | 0.053 | 0.053 | 0.053 | 0.053 | 0.053 | 0.053 | 0.053 |
| | Solvent *d | 0.27 | 0.27 | 0.27 | 0.27 | 0.27 | 0.27 | 0.27 | 0.27 | 0.27 |
| | Gelatin | 1.60 | 1.60 | 1.60 | 1.60 | 1.60 | 1.60 | 1.60 | 1.60 | 1.60 |
| Third Layer (Green-sensitive layer) | Silver chlorobromide emulsion (bromide content: 70 mol %) | 0.18 | 0.18 | 0.18 | 0.13 | 0.18 | 0.14 | 0.14 | 0.11 | 0.17 |
| | Magenta coupler M-5 | 0.26 | 0.26 | 0.26 | 0.28 | 0.26 | 0.29 | 0.29 | 0.29 | 0.27 |
| | Color fading preventing agent *i | 0.15 | 0.15 | 0.15 | 0.16 | 0.15 | 0.17 | 0.17 | 0.17 | 0.155 |
| | Solvent *g | 0.41 | 0.41 | 0.41 | 0.44 | 0.41 | 0.46 | 0.46 | 0.46 | 0.43 |
| | Gelatin | 1.35 | 1.35 | 1.35 | 1.35 | 1.35 | 1.35 | 1.35 | 1.35 | 1.35 |
| Second Layer (Color mixing preventing layer) | Color mixing preventing agent *h | 0.08 | 0.08 | 0.08 | 0.08 | 0.08 | 0.08 | 0.08 | 0.08 | 0.08 |
| | Gelatin | 0.09 | 0.09 | 0.09 | 0.09 | 0.09 | 0.09 | 0.09 | 0.09 | 0.09 |
| First Layer (Blue-sensitive layer) | Silver chlorobromide emulsion (bromide content: 80 mol %) | 0.40 | 0.35 | 0.40 | 0.40 | 0.30 | 0.34 | 0.30 | 0.30 | 0.36 |
| | Yellow coupler *j | 0.68 | 0.82 | 0.68 | 0.68 | 1.02 | 0.84 | 1.02 | 1.02 | 0.80 |
| | Color fading preventing agent *k | 0.16 | 0.19 | 0.16 | 0.16 | 0.24 | 0.20 | 0.24 | 0.24 | 0.19 |
| | Solvent *d | 0.27 | 0.33 | 0.27 | 0.27 | 0.41 | 0.33 | 0.41 | 0.41 | 0.32 |
| | Gelatin | 1.30 | 1.30 | 1.30 | 1.30 | 1.30 | 1.30 | 1.30 | 1.30 | 1.30 |
| Support | Paper support, both surfaces of which were laminated with poly- | | | | | | | | | |

TABLE 1-continued
| Layer | Composition | A | Sample B | C | D | E | F | Sample G | H | I |
|---|---|---|---|---|---|---|---|---|---|---|
| | ethylene | | | | | | | | | |
*Coating amount (g/m$^2$)
**Polyvinyl alcohol-acrylic acid copolymer (acrylic acid content 17 mol %)
*a
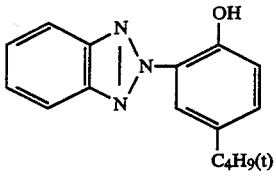
*b
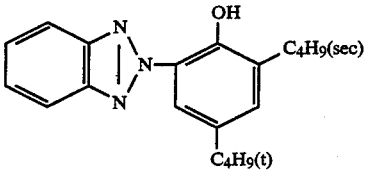
*c
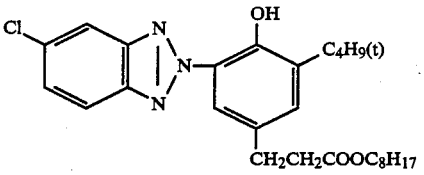
*d (iso-$C_9H_{19}$)$_3$P=O
*e
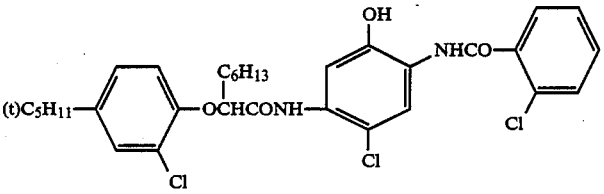
*f
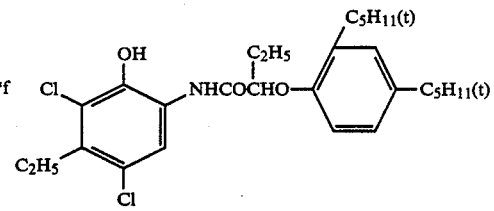
*g
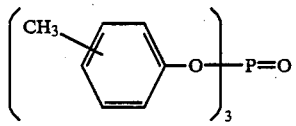
*h
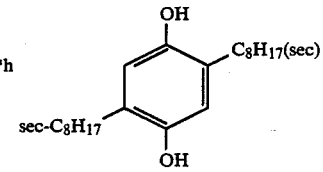

TABLE 1-continued

| Layer | Composition | A | Sample B | C | D | E | F | Sample G | H | I |
|---|---|---|---|---|---|---|---|---|---|---|
| *i | 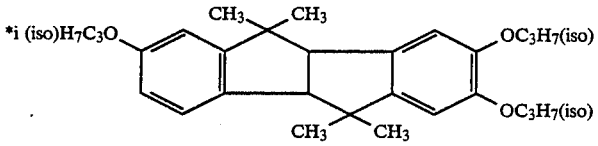 | | | | | | | | | |
| *j | 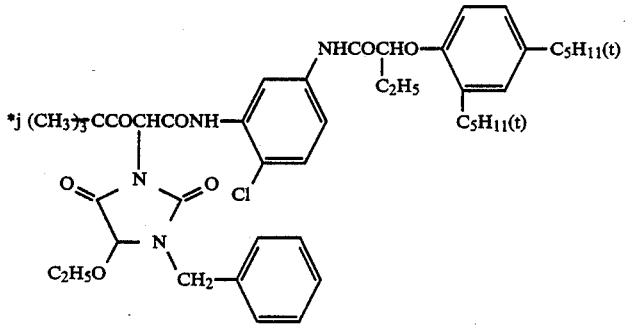 | | | | | | | | | |
| *k | 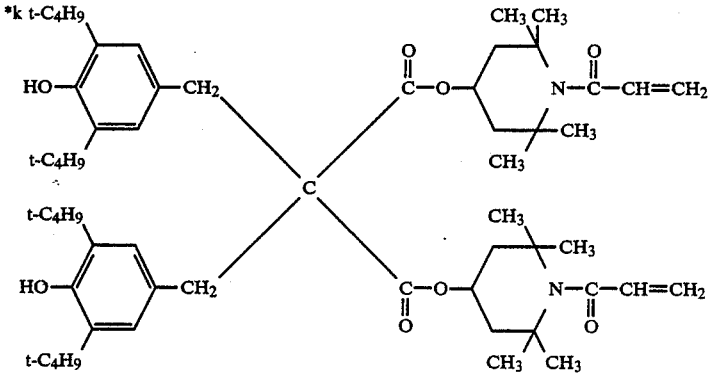 | | | | | | | | | |

The following compounds were used as spectral sensitizing dyes for each emulsion layer.

Blue-Sensitive Emulsion Layer: 3,3'Di-(3-sulfopropyl)-senlenacyanine sodium salt ($2\times10^{-4}$ mols per mol of silver halide)

Green-Sensitive Emulsion Layer: 3,3'-Di-(3-sulfopropyl)-5,5'-diphenyl-9-ethyloxacarbocyanine sodium salt ($2.5\times10^{-4}$ mols per mol of silver halide)

Red-Sensitive Emulsion Layer: 3,3'-Di-(3-sulfopropyl)-9-methylthiadicarbocyanine sodium salt ($2.5\times10^{-4}$ mols per mol of silver halide)

These samples were imagewise exposed to light and then subjected to continuous processing according to the processing steps as shown below using a Fuji Color Paper Processor FMPP-1000 (manufactured by Fuji Photo Film Co., Ltd.).

| Processing Step | Time | Temperature | Capacity of Tank | Amount of Replenisher (ml/m²) |
|---|---|---|---|---|
| Color Development | 3 min 30 sec | 33° C. ± 0.15° C. | 88 l | 327 |
| Bleach-Fixing | 1 min 30 sec | 33° C. ± 3° C. | 35 l | 60 |
| Washing with Water (1) | 40 sec | 24 ~ 34° C. | 17 l | — |
| Washing with Water (2) | 40 sec | 24 ~ 34° C. | 17 l | — |

-continued

| Processing Step | Time | Temperature | Capacity of Tank | Amount of Replenisher (ml/m²) |
|---|---|---|---|---|
| Washing with Water (3) | 40 sec | 24 ~ 34° C. | 17 l | about 10,000 |

The washing with water steps were carried out by a three-stage countercurrent water washing process from washing with water (3) to washing with water (1).

The composition of each tank solution and replenisher used was as follows.

| | Tank Solution | Replenisher |
|---|---|---|
| Color Developing Solution | | |
| Water | 800 ml | 800 ml |
| Diethylenetriaminepentaacetic acid | 3.0 g | 3.0 g |
| Benzyl alcohol | 15 ml | 17 ml |
| Diethylene glycol | 10 ml | 10 ml |
| Sodium sulfite | 2.0 g | 2.5 g |
| Potassium bromide | 0.5 g | — |
| Sodium carbonate | 30 g | 35 g |
| N-Ethyl-N-(β-methanesulfonamidoethyl)-3-methyl-4-aminoaniline sulfate | 5.0 g | 7.0 g |
| Hydroxylamine sulfate | 4.0 g | 4.5 g |

-continued

| | Tank Solution | Replenisher |
|---|---|---|
| Fluorescent whitening agent | 1.0 g | 1.5 g |
| Water to make | 1000 ml (pH 10.10) | 1000 ml (pH 10.50) |
| Bleach-Fixing Solution | | |
| Water | 400 ml | 400 ml |
| Ammonium thiosulfate (70% soln.) | 150 ml | 300 ml |
| Sodium sulfite | 18 g | 36 g |
| Ammonium ethylenediaminetetra-acetate iron (III) | 55 g | 110 g |
| Disodium ethylenediaminetetra-acetate | 5 g | 10 g |
| Water to make | 1000 ml (pH 6.70) | 1000 ml (pH 6.50) |

Under the above-described conditions, each sample exposed imagewise was processed at a rate of a roll paper of 8.25 cm wide and 600 m long per day for 10 days (Processing A), and at a rate of a roll paper of 8.25 cm wide and 100 m long per day for 6 days (Processing B).

Further, in order to determine the changes in photographic properties, each sample was exposed through a continuous wedge and processed on the first day and the last day of processing.

Green reflective density of the magenta dye image thus obtained was measured using a color automatic recording densitometer FCD (manufactured by Fuji Photo Film Co., Ltd.) and the maximum density (D max) and relative sensitivity were determined. The results thus obtained are shown in Table 2 below.

TABLE 2

| Sample | Total Amount of Silver Coated ($g/m^2$) | Silver/Coupler Ratio in Green-Sensitive Layer (mol/mol) | Processing A Start of Processing Dmax | Processing A Start of Processing RS* | Processing A Finish of Processing Dmax | Processing A Finish of Processing RS | Processing B Start of Processing Dmax | Processing B Start of Processing RS | Processing B Finish of Processing Dmas | Processing B Finish of Processing RS |
|---|---|---|---|---|---|---|---|---|---|---|
| A (Comparison) | 0.80 | 5.6 | 2.57 | 100 | 2.26 | 83 | 2.57 | 100 | 2.69 | 107 |
| B (Present invention) | 0.75 | 5.6 | 2.65 | 104 | 2.56 | 99 | 2.65 | 104 | 2.68 | 105 |
| C (Present invention) | 0.75 | 5.6 | 2.67 | 105 | 2.58 | 100 | 2.67 | 105 | 2.68 | 106 |
| D (Present invention) | 0.75 | 3.8 | 2.55 | 97 | 2.50 | 95 | 2.55 | 97 | 2.57 | 98 |
| E (Present invention) | 0.70 | 5.6 | 2.67 | 105 | 2.60 | 101 | 2.67 | 105 | 2.66 | 104 |
| F (Present invention) | 0.70 | 4.0 | 2.64 | 102 | 2.62 | 100 | 2.63 | 102 | 2.63 | 102 |
| G (Present invention) | 0.66 | 4.0 | 2.61 | 100 | 2.62 | 100 | 2.61 | 100 | 2.62 | 100 |
| H (Present invention) | 0.60 | 3.0 | 2.56 | 97 | 2.55 | 97 | 2.55 | 97 | 2.57 | 98 |
| I (Present invention) | 0.75 | 5.0 | 2.60 | 102 | 2.55 | 99 | 2.60 | 102 | 2.60 | 102 |

*RS = Relative sensitivity

From the results shown in Table 2 above, it is apparent that, with Sample A, Dmax and relative sensitivity at the finish of continuous processing of Processing A in which an amount of the photographic material processed per day is large are remarkably decreased in comparison with those at the start of continuous processing, while Dmax and relative sensitivity at the finish of continuous processing of Processing B in which an amount of the photographic material processed per day is small are increased in comparison with those at the start of continuous processing.

From the results of Samples B to I, it is apparent that the light-sensitive materials in which the total amount of silver coated is 0.75 $g/m^2$ or less maintain Dmax and relative sensitivity of the starting period of continuous processing at the finish of continuous processings of both Processing A and Processing B and they are fit for practical use. Also it is understood that these effects can be attained by decreasing the coating amount of silver in any silver halide emulsion layer.

From the results of Samples D and F to I, it is apparent that the cases wherein the total amount of silver coated is 0.75 $g/m^2$ or less and the silver/coupler ratio in the green-sensitive layer is 5 or less are more preferred particularly in Processing A.

Further, from the results of Samples F to H it is apparent that the cases wherein the total amount of silver coated is 0.70 $g/m^2$ or less and the silver/coupler ratio in the green-sensitive layer is 4 or less are much more preferred.

EXAMPLE 2

On a paper support, both surfaces of which were laminated with polyethylene, a first layer (the undermost layer) to a seventh layer (the uppermost layer) were coated as shown in Table 3 below using magenta couplers M-1, M-4, M-7, M-15 and M-43 according to the present invention and 5-pyrazolone type magenta coupler for comparison as shown below respectively to prepare multilayer color photographic materials, Samples J to O. The coating solutions were prepared in the same manner as described in Example 1 except that Alkanol B (alkylnapthalenesulfonate manufactured by du Pont) was used in place of sodium dodecyl benzenesulfonate and 1,2-bis(vinylsulfonyl)ethane was used in place of 2,4-dichloro-6-hydroxy-s-triazine sodium salt as a hardening agent.

These samples were processed in the same manner as described in Example 1. Dmax and relative sensitivity of each magenta dye image obtained at the start and finish of Processing A having a large amount of processing per day and Processing B having a small amount of processing per day were determined. The results thus obtained are shown in Table 4 below.

Magenta Coupler for Comparison

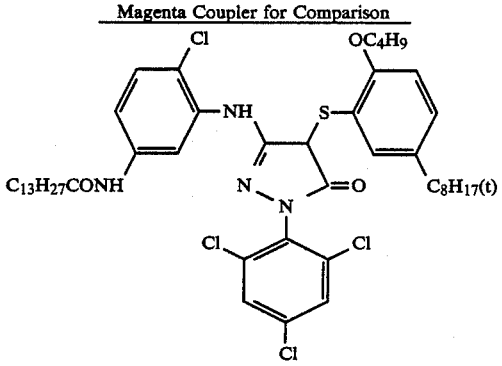

TABLE 3

| Layer | Composition | |
|---|---|---|
| Seventh Layer (Protective layer) | Gelatin | 600 mg/m$^2$ |
| Sixth Layer (Ultraviolet ray absorbing layer) | Ultraviolet ray absorbing agent (*a) | 260 mg/m$^2$ |
| | Ultraviolet ray absorbing agent (*b) | 70 mg/m$^2$ |
| | Solvent (*c) | 300 mg/m$^2$ |
| | Solvent (*d) | 100 mg/m$^2$ |
| | Gelatin | 700 mg/m$^2$ |
| Fifth Layer (Red-sensitive layer) | Silver chlorobromide emulsion (bromide content: 74 mol %) | 210 mg/m$^2$ (as silver) |
| | Cyan coupler (*e) | 260 mg/m$^2$ |
| | Cyan coupler (*f) | 120 mg/m$^2$ |
| | Color fading preventing agent (*g) | 250 mg/m$^2$ |
| | Solvent (*c) | 160 mg/m$^2$ |
| | Solvent (*d) | 100 mg/m$^2$ |
| | Gelatin | 1,800 mg/m$^2$ |
| Fourth Layer (Color mixing preventing layer) | Color mixing preventing agent (*h) | 65 mg/m$^2$ |
| | Ultraviolet ray absorbing agent (*a) | 450 mg/m$^2$ |

TABLE 3-continued

| Layer | Composition | |
|---|---|---|
| | Ultraviolet ray absorbing agent (*b) | 230 mg/m$^2$ |
| | Solvent (*c) | 50 mg/m$^2$ |
| | Solvent (*d) | 50 mg/m$^2$ |
| | Gelatin | 1,700 mg/m$^2$ |
| Third Layer (Green-sensitive layer) | Silver chlorobromide emulsion (bromide content: 74 mol %) | 150 mg/m$^2$ (as silver) |
| | Magenta coupler | 0.35 mmol/m$^2$ |
| | Color fading preventing agent (*i) | 150 mg/m$^2$ |
| | Color fading preventing agent (*j) | 10 mg/m$^2$ |
| | Solvent (*c) | 200 mg/m$^2$ |
| | Solvent (*d) | 10 mg/m$^2$ |
| | Gelatin | 1,400 mg/m$^2$ |
| Second Layer (Color mixing preventing layer) | Silver bromide emulsion | 10 mg/m$^2$ (as silver) |
| | Color mixing preventing agent (*h) | 55 mg/m$^2$ |
| | Solvent (*c) | 30 mg/m$^2$ |
| | Solvent (*d) | 15 mg/m$^2$ |
| | Gelatin | 800 mg/m$^2$ |
| First Layer (Blue-sensitive layer) | Silver chlorobromide emulsion (bromide content: 90 mol %) | 290 mg/m$^2$ (as silver) |
| | Yellow coupler (*k) | 600 mg/m$^2$ |
| | Color fading preventing agent (*g) | 280 mg/m$^2$ |
| | Solvent (*c) | 30 mg/m$^2$ |
| | Solvent (*d) | 15 mg/m$^2$ |
| | Gelatin | 1,800 mg/m$^2$ |
| Support | Paper support, both surfaces of which were laminated with polyethylene | |

*a 2-(2-Hydroxy-3,5-di-tert-amylphenyl)benzotriazole
*b 2-(2-Hydroxy-3,5-di-tert-butylphenyl)benzotriazole
*c Di-(2-ethylhexyl)phthalate
*d Dibutyl phthalate
*e 2-Pentafluorobenzamido-4-chloro-5-[2-(2,4-di-tert-amylphenoxy)-3-methylbutyl-]amidophenol
*f 2,4-Dichloro-3-methyl-6-[-(2,4-di-tert-amylphenoxy)-butyramido]phenol
*g 2,5-Di-tert-amylphenyl-3,5-di-tert-butylhydroxy-benzoate
*h 2,5-Di-tert-octylhydroquinone
*i 1,4-Di-tert-amyl-2,5-di-octyloxybenzene
*j 2,2'-Methylenebis(4-methyl-6-tert-butylphenol)
*k α-Pivaloyl-α-(3-benzyl-1-hydantoinyl)-2-chloro-5-[-2,4-di-tert-amylphenoxy)-butyramido]acetanilide Further, the following spectral sensitizing dyes were employed in the emulsion layers, respectively, Blue-Sensitive Emulsion Layer: Anhydro -5-methoxy-5'-methyl-3,3'-disulfopropylselenacyanine hydroxide ($2.5\times10^{-4}$ mols per mol of silver halide)

Green-Sensitive Emulsion Layer: Anhydro-9-ethyl-5,5'-diphenyl-3,3'-disulfoethyloxacarbocyanine hydroxide ($2\times10^{-4}$ mols per mol of silver halide)

Red-Sensitive Emulsion Layer: 3,3'-Diethyl-5-methoxy-9,9'-(2,2-dimethyl -1,3-propane) thiadicarbocyanine isodide ($2\times10^{-4}$ mols per mol of silver halide)

TABLE 4

| Sample | Total Amount of Silver Coated (g/m$^2$) | Silver Coupler Ratio in Green-Sensitive Layer (mol/mol) | Magenta Coupler | Processing A Start of Processing Dmax | Processing A Start of Processing RS* | Processing A Finish of Processing Dmax | Processing A Finish of Processing RS | Processing B Start of Processing Dmax | Processing B Start of Processing RS | Processing B Finish of Processing Dmax | Processing B Finish of Processing RS |
|---|---|---|---|---|---|---|---|---|---|---|---|
| J (Present Invention) | 0.65 | 4.0 | M-1 | 2.70 | 98 | 2.65 | 96 | 2.69 | 98 | 2.70 | 98 |
| K (Present Invention) | " | " | M-4 | 2.65 | 96 | 2.66 | 97 | 2.65 | 96 | 2.64 | 96 |
| L (Present | " | " | M-7 | 2.64 | 97 | 2.61 | 96 | 2.64 | 97 | 2.66 | 98 |

TABLE 4-continued

| Sample | Total Amount of Silver Coated ($g/m^2$) | Silver Coupler Ratio in Green-Sensitive Layer (mol/mol) | Magenta Coupler | Processing A Start of Processing Dmax | Processing A Start of Processing RS* | Processing A Finish of Processing Dmax | Processing A Finish of Processing RS | Processing B Start of Processing Dmax | Processing B Start of Processing RS | Processing B Finish of Processing Dmax | Processing B Finish of Processing RS |
|---|---|---|---|---|---|---|---|---|---|---|---|
| Invention) | | | | | | | | | | | |
| M (Present Invention) | " | " | M-15 | 2.67 | 98 | 2.65 | 98 | 2.66 | 98 | 2.67 | 98 |
| N (Present Invention) | " | " | M-43 | 2.63 | 97 | 2.62 | 96 | 2.64 | 97 | 2.63 | 97 |
| O (Comparison) | " | " | Comparative Coupler | 2.75 | 100 | 2.73 | 99 | 2.75 | 100 | 2.75 | 100 |

*RS = Relative sensitivity

From the results shown in Table 4 above, it is apparent that all samples maintain Dmax and relative sensitivity of the starting period of continuous processing at the finish of continuous processings of both Processing A and Processing B to the same extent of those obtained from conventional 5-pyrazolone type magenta coupler and these samples are fit for practical use.

Further, from the results of Samples K, M and N, it is understood that more preferred couplers are those having a group connected to the pyrazoloazole ring through a secondary or tertiary carbon atom and containing a—$NHSO_2$—substituent.

Then, Samples J to O were printed through a color negative film after exposure and development using a color printer and subjected to development processing according to the processing steps as shown below.

| Processing Step | Temperature (°C.) | Time |
|---|---|---|
| Development | 33 | 3 min 30 sec |
| Bleach-Fixing | 33 | 1 min 30 sec |
| Washing with Water | 28–35 | 3 min |

Processing solutions used in each step had the following compositions:

| | |
|---|---|
| Developing Solution: | |
| Benzyl alcohol | 15 ml |
| Diethylenetriaminepentaacetic acid | 5 g |
| KBr | 0.4 g |
| $Na_2SO_3$ | 5 g |
| $Na_2CO_3$ | 30 g |
| Hydroxylamine sulfate | 2 g |
| 4-Amino-3-methyl-N-ethyl-N-β-(methanesulfonamido)ethylaniline $3/2H_2SO_4$ $H_2O$ | 4.5 g |
| Water to make | 1,000 ml (pH = 10.1) |
| Bleach-Fixing Solution: | |
| Ammonium thiosulfate (70 wt %) | 150 ml |
| $Na_2SO_3$ | 5 g |
| Na[Fe(EDTA)] | 40 g |
| EDTA | 4 g |
| Water to make | 1,000 m (pH = 6.8) |

From the comparison of color prints thus obtained, it is apparent that in the color prints obtained from Samples J to N containing the couplers according to the present invention, color reproduction particularly that of red and blue objects is extremely clear in comparison with the color print obtained from Sample 0 containing the comparative 5-pyrazolone type coupler.

Samples J to 0 were exposed to green light through a continuous wedge and subjected to development processing in the same manner as described above to obtain magenta dye images. These samples were subjected to fading test using a fluorescent lamp fade meter (15,000 lux) for 30 days. The results thus obtained are shown in Table 5 below.

TABLE 5

| Sample | Magenta Color Image Density after Fluorescent Lamp Irradiation: Initial Density 1.0 | Initial Density 2.0 | White Background |
|---|---|---|---|
| J (Present Invention) | 0.91 | 1.87 | 0.04 |
| K (Present Invention) | 0.90 | 1.85 | 0.04 |
| L (Present Invention) | 0.87 | 1.78 | 0.05 |
| M (Present Invention) | 0.92 | 1.83 | 0.04 |
| N (Present Invention) | 0.91 | 1.85 | 0.04 |
| O (Comparison) | 0.75 | 1.48 | 0.15 |

From the results shown in Table 5 above, it is apparent that the couplers according to the present invention exhibit excellent properties in that light fastness of the color images formed therefrom is superior and in that the occurrence of stain which is believed to be caused upon decomposition of the couplers is less as compared with the comparative coupler.

Further, the same tendency was observed in samples at the finish of continuous processing of Processing B.

It is understood from the results shown in Examples 1 and 2 that silver halide color photographic materials providing color images having improved color reproducibility and preservability and being excellent in processing stability by means of using the pyrazoloazole type magenta coupler represented by the general formula (I) and keeping the total coating amount of silver in the photographic material 0.75 $g/m^2$ or less.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon a blue-sensitive silver halide emulsion layer, a green-sensitive silver halide emulsion layer and a red-sensitive silver halide emulsion layer, wherein the silver halide color photographic material contains at least one kind of pyrazoloazole type magenta coupler represented by the general Formulae (Va) or (VIa) described below and the total coating amount of silver in the photographic material is 0.75 g/m$^2$ or less:

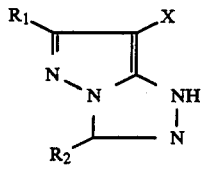

(Va)

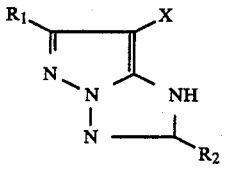

(VIa)

wherein $R^1$ represents a hydrogen atom or a substituent; X represents a hydrogen atom or a group capable of being released upon a coupling reaction with an oxidation product of an aromatic primary amine developing agent; $R^1$ or X may also form a polymer including a dimer or more and $R_2$ represents a ballast group.

2. A silver halide color photographic material as claimed in claim 1, wherein the total coating amount of silver in the photographic material is 0.70 g/m$^2$ or less.

3. A silver halide color photographic material as claimed in claim 1, wherein the pyrzoloazole type coupler is represented by the general formula (VIa).

4. A silver halide color photographic material as claimed in claim 1, wherein at least one of $R_1$ and $R_2$ is a group connected to the pyrazolotriazole ring through a secondary or tertiary carbon atom and at least one of $R_1$ and $R_2$ is a group containing a —$NHSO_2$—group.

5. A silver halide color photographic material as claimed in claim 1, wherein the pyrazoloazole type magenta coupler is present in a green-sensitive silver halide emulsion layer.

6. A silver halide color photographic material as claimed in claim 5, wherein the coating amount of silver in the green-sensitive silver halide emulsion layer is 5 moles or less per mol of the pyrazoloazole type magenta coupler.

7. A silver halide color photographic material as claimed in claim 5, wherein the total coating amount of silver in the photographic material is 0.70 g/m$^2$ or less and the coating amount of silver in the green-sensitive silver halide emulsion layer is 4 moles or less per mol of the pyrazoloazole type magenta coupler.

8. A silver halide color photographic material as claimed in claim 1, wherein the blue-sensitive silver halide emulsion layer contains a yellow color forming coupler and the red-sensitive silver halide emulsion layer contains a cyan color forming coupler.

9. A silver halide color photographic material as claimed in claim 8, wherein the yellow color forming coupler is an open-chain or heterocyclic keto-methylene type compound and the cyan color forming coupler is a naphthol or phenol type compound.

10. A silver halide color photographic material as claimed in claim 1, wherein the silver halide color photographic material is a color paper, a color reversal paper, a color reversal film or a color positive film.

11. A method for forming an image using the silver halide color photographic material as claimed in claim 1, wherein the silver halide color photographic material is imagewise exposed, developed with an aqueous alkaline solution containing an aromatic primary amine developing agent and bleach fixed.

12. A method for forming an image as claimed in claim 11, wherein the photographic material is subjected to washing with water or stabilizing after the bleach-fixing process.

13. A method for forming an image as claimed in claim 11, wherein the breach-fixing process is carried out with an aqueous solution containing an iron (III) complex salt of ethylenediaminetetraacetic acid.

14. A method for forming an image as claimed in claim 11, wherein the aromatic primary amine developing agent is N-ethyl-N- 5-methanesulfonamidoethyl)3-methyl-4-aminoaniline sulfate.

* * * * *